US005524470A

United States Patent [19]

Rozmus

[11] Patent Number: 5,524,470

[45] Date of Patent: Jun. 11, 1996

[54] PLUG MILL BOTTOM ROLL ADJUSTMENT

[75] Inventor: William Rozmus, Pittsburgh, Pa.

[73] Assignee: Italimplanti of America, Inc., Coraopolis, Pa.

[21] Appl. No.: 217,442

[22] Filed: Mar. 24, 1994

[51] Int. Cl.[6] ..... B21B 31/07; B21B 31/18

[52] U.S. Cl. ..... 72/247; 72/244; 74/109; 74/110

[58] Field of Search ..... 72/237, 244, 247, 72/449; 74/109, 110

[56] References Cited

U.S. PATENT DOCUMENTS

| | | | |
|---|---|---|---|
| 2,175,783 | 10/1939 | Rose | 80/56 |
| 2,184,463 | 12/1939 | Morgan | 80/56 |
| 2,335,800 | 11/1943 | Sheperdson et al. | 80/56 |
| 2,734,406 | 2/1956 | O'Malley | 80/55 |
| 3,429,167 | 2/1969 | Sieurin et al. | 72/247 |
| 3,750,448 | 8/1973 | Oxlade | 72/247 |
| 3,861,190 | 1/1975 | Maltby et al. | 72/247 |
| 3,911,714 | 10/1975 | Kamimura et al. | 72/209 |
| 4,059,794 | 11/1977 | Furness et al. | 324/208 |
| 4,154,074 | 5/1979 | Sieurin et al. | 72/21 |
| 4,203,310 | 5/1980 | Krylov et al. | 72/247 |
| 4,770,021 | 9/1988 | Kobayashi et al. | 72/247 |
| 4,848,128 | 7/1989 | Bohnenkamp et al. | 72/247 |
| 4,967,582 | 11/1990 | Bohnenkamp | 72/247 |
| 5,146,409 | 9/1992 | Atkinson | 364/472 |

*Primary Examiner*—Lowell A. Larson
*Assistant Examiner*—Rodney A. Butler
*Attorney, Agent, or Firm*—Webb Ziesenheim Bruening

[57] ABSTRACT

An apparatus for axially adjusting a bottom work roll of a plug mill to align the grooves of the top and bottom rolls. The apparatus includes a bottom roll chock having a pair of laterally extending members, each carrying a transverse, tapered wing shaped end portion. A pair of spaced apart adjustment assemblies are mounted on the plug mill housing adjacent the lower roll chock. A pair of tapered wedges is carried by each of the adjustment assemblies. The wedges are adapted to slideably engage and move the tapered wing shaped portions of the lower roll chock. A segmented tie bar having a manually rotatable turnbuckle is rigidly attached to lever arms carried by the adjustment assemblies. Rotation of the turnbuckle, which carries conventional left hand and right hand threads, causes identical outward or inward movement of the tie bar segments and lever arms which, in turn, causes like rotative movement of a gear train positioned within the adjustment assemblies resulting in opposite sliding movement of the pairs of tapered wedges. The movement of the tapered wedges against the tapered wing shaped portions of the roll chock causes selective inward or outward movement of the roll chock and axial movement of the bottom work roll.

10 Claims, 3 Drawing Sheets

PLUG MILL BOTTOM ROLL ADJUSTMENT

BACKGROUND OF THE INVENTION

The present invention relates generally to rolling mills and, more particularly, to so-called plug mills which are used to form elongated tubular shapes, such as, for example, metal pipe. Plug mills are usually two high mills, that is to say, they have two vertically spaced work rolls. The work rolls have axially extending shafts which are journaled for rotation in bearings which, in turn, are mounted in roll chocks. The roll chocks are then mounted in the mill housing, all of which is well-known in the art. The work rolls of the plug mill each have one or more hemispherically shaped grooves circumferentially formed therearound which mate to form a circular cross section when the rolls are brought together and axially aligned in the mill housing. A tubular workpiece having a circular cross section is then passed through the mating grooves of the work rolls while a plug mandrel is positioned within the hollow, workpiece. The plug functions to counteract the external rolling forces of the grooved work rolls to provide the desired workpiece deformation/elongation and dimensions, all well-known in the art.

In preparation for start-up, after the grooved work rolls have been placed in the mill housing, it is sometimes necessary to axially move at least one of the roll chocks in order to properly align the roll grooves prior to commencing operation of the mill. Heretofore, axial adjustment of the grooved rolls in a plug mill has been accomplished by manipulation of one of the roll chocks through the use of shims and wedges. This adjustment operation has proved to be a time consuming and labor intensive task. Pinch points are also present in the mill which present potential hazards for the installation personnel.

The present invention is directed to a device for axially adjusting the bottom roll chock of a plug mill to provide fast, safe and efficient alignment of the roll grooves of the top and bottom work rolls. The roll adjustment device of the present invention further provides for controlled axial movement of the bottom work roll in two directions relative to the pass line of the mill to allow very accurate roll adjustment in a minimum amount of time and with the utmost safety.

Still further, the roll adjustment device of the invention is adapted to be easily installed on new or existing mills with relatively little capital expense.

SUMMARY OF THE INVENTION

Briefly stated, the present invention is directed to an apparatus for axially adjusting a bottom work roll of a plug mill in order to align a bottom roll groove with a top roll groove. The invention comprises a bottom roll chock having a pair of laterally extending members, each carrying a transverse, tapered wing shaped end portion. A pair of spaced apart adjustment assemblies are mounted on the plug mill housing adjacent the lower roll chock. A pair of tapered wedges are carried by each of the adjustment assemblies. Each of the pair of wedges are adapted to slideably engage one of the tapered wing shaped portions of the lower roll chock. The tapered wedges each carry a rack gear at one end thereof. A pinion gear is positioned between each pair of tapered wedges operably engaging the rack gear of each. A lever arm having a pinion gear attached thereto rotatably engages the aforementioned gears of the tapered wedges. A segmented tie bar having a manually rotatable turnbuckle is rigidly attached to the respective lever arms on each of the adjustment assemblies. Selective rotation of the turnbuckle causes identical outward or inward movement of the tie bar segments and lever arms which, in turn, causes like rotative movement of the mating gears, resulting in identical sliding movement of the two pairs of tapered wedges. The movement of the tapered wedges against the tapered wing shaped portions of the roll chock causes selective inward or outward movement of the roll chock and concurrent axial movement of the bottom work roll. Thus, selective rotation of the turnbuckle provides quick and easy axial alignment between the tube receiving grooves of the top and bottom work rolls of a plug mill.

The plug mill also preferably includes a pair of vertical locking plates slidably mounted on the mill housing. The locking plates are moveable by hydraulic means in two directions, into or away from the mill window to selectively lock or release the top and bottom roll chocks in the mill housing.

DETAILED DESCRIPTION OF THE INVENTION

Figure 1:
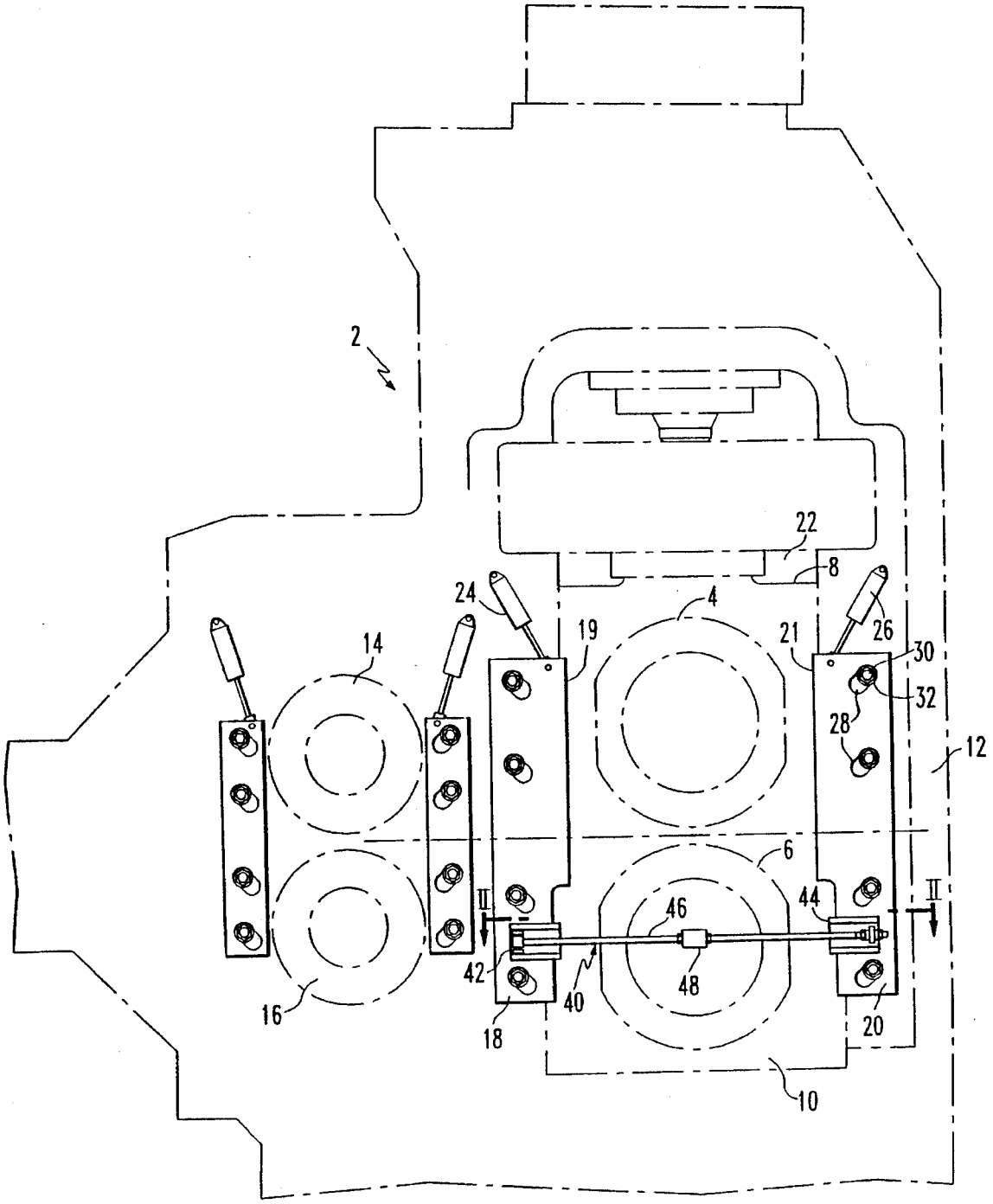
FIG. 1 is a side elevation view of a plug mill with the roll adjustment device of the invention and vertical locking plates in place thereon.

The plug mill 2 shown in FIG. 1 is a typical two high mill having vertically spaced top and bottom grooved work rolls 4 and 6, respectively. Plug mills are well-known and are used for producing an elongated tubular shape such as metal pipe with the aid of a non-rotating plug mandrel (not shown) which engages the inside of a tubular workpiece while the grooved portion of the work rolls engages the outside surface of the workpiece. The top and bottom work rolls 4 and 6 have end shafts which are journaled for rotation in bearing assemblies within respective top and bottom roll chocks 8 and 10 which, in turn, are mounted in a frame-like mill housing 12 forming the plug mill 2.

A pair of smaller, so-called stripper rolls 14 and 16 are positioned downstream from the work rolls and function to return the rolled tube after a first pass to a position upstream of the mill. The tube is then rotated 90° and rolled in a second and final pass through the mill 2, all well-known in the art.

A pair of vertical locking plates 18 and 20 are slideably mounted for controlled movement on opposed sides of the mill housing 12. The housing 12 has an open interior or so-called mill window 22 into which the top and bottom roll chocks 8 and 10 (comprising an assembled roll chock and work roll) are inserted. The locking plates 18 and 20 move laterally into and out of the area of the mill window 22 by way of hydraulically actuated cylinders 24 and 26, respectively. The hydraulic cylinders each carry an extensible and retractable piston rod which are attached to a respective locking plate as depicted in FIG. 1.

The locking plates have a plurality of elongated slots 28 formed therethrough to permit the insertion of a flanged fastener 30 into each of the slots. The fasteners 30 are threadably secured at one end to the mill housing 12 and carry a flanged portion 32 at the other end. The flanged portion 32 of fastener 30 is dimensionally greater than the width of the slot 28 to hold the locking plate on the housing. A very slight clearance is also provided between the flange portions 32 and the facing, outer surface of the respective locking plates to permit the desired slideable movement of the locking plates in the elongated slots 28 when the hydraulic cylinders 24 and 26 are energized.

When the piston rods of the hydraulic cylinders 24 and 26 are retracted, the respective locking plates 18 and 20 move upwardly and laterally to an open position away from the area of the mill window 22. In the open position, the roll chock 8 and 10 can be inserted or removed from the window 22 of the mill housing 12. When the roll chock assemblies are inserted into the mill housing, the hydraulic cylinders 24 and 26 are energized to extend the piston rods thereof which causes simultaneous downward and inward movement of the vertical locking plates 18 and 20 to a locked position. The locking plates each carry an inside edge portion 19 and 21, respectively. The edge portions 19 and 20 slideably overlap the roll chocks 8 and 10 when the locking plates are moved to the locked position to securely hold the roll chock assemblies in the mill housing 12.

Occasionally, due to wear and the like, extra clearances may exist between the roll chocks and the mill housing. This condition may cause the grooves of the work rolls to be slightly misaligned after the chocks have been inserted into the mill frame. Under such circumstances, it is necessary prior to start-up to axially align the grooves of the work rolls 4 and 6 employing the adjustment device of the present invention, generally designated 40 in the drawings.

Figure 2:
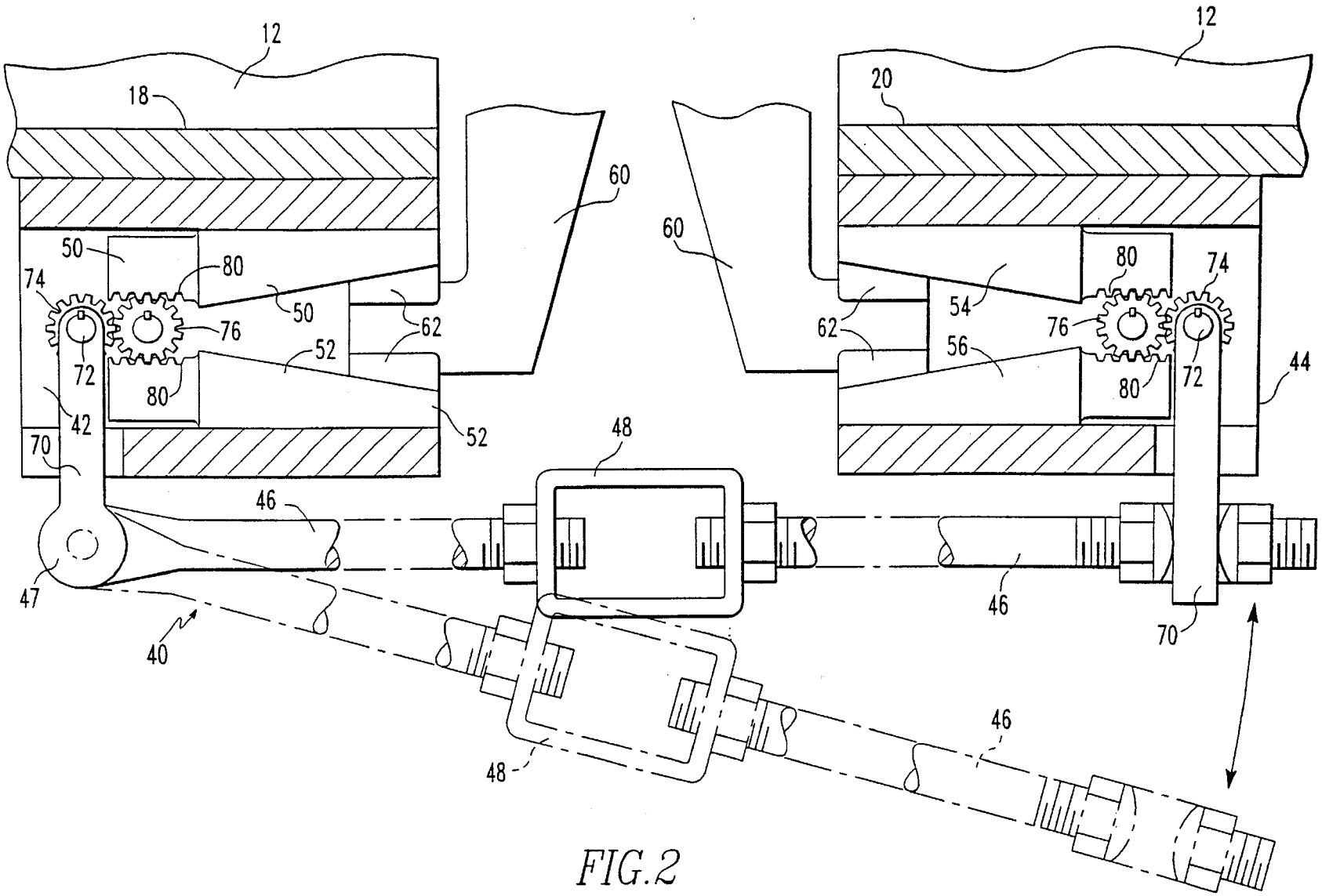
FIG. 2 is a partial cross sectional plan view of the entire roll adjustment device of the invention taken along line II—II of FIG. 1.

The roll adjustment device 40 comprises a pair of nearly identical adjustment assemblies 42 and 44, each mounted on respective locking plates 18 and 20 and positioned along a horizontal plane passing through the longitudinal axis of the bottom roll 6. The adjustment assemblies 42 and 44 are interconnected by a two-segment tie bar 46 which includes a rotatable turnbuckle 48 joining the two segments. The tie bar segments are conventional and include threaded ends which are threadably coupled to the turnbuckle 48. Manual rotation of the turnbuckle 48 causes identical movement in the tie bar segments 46 in either an outward direction or in an inward direction, depending upon the direction of rotation of the turnbuckle. As best seen in FIG. 2, the tie bar 46 is pivotally attached by a joint 47 at one end to permit the tie bar to be swung away from the mill housing to provide clearance to allow insertion or removal of the roll chock 10 into or from the mill.

The adjustment assemblies 42 and 44 each contain a respective pair of moveable, tapered wedges 50, 52 in assembly 42 and wedges 54, 56 in assembly 44. The bottom roll chock 10 includes a pair of laterally extending members 60, having transverse, tapered wing shaped end portions 62 which are each slideably engaged by a respective pair of wedges 50, 52 and 54, 56. The two laterally extending members 60 are integral with the bottom roll chock 10 and are positioned in a spaced-apart relationship on opposite sides of the bottom roll shaft. As will be explained in greater detail hereinafter, rotative movement of the turnbuckle 48 causes movement of the wedges which results in axial movement of the bottom roll chock and roll 6.

The adjustment assemblies 42 and 44 are identical in operation and cause simultaneous and identical movement of the transverse, tapered ends 62 of the laterally extending members 60 and the roll chock 10. The adjustment assemblies each include a lever arm 70 which is engaged by the tie bar 46 at its outer end. Lever arm 70 of the left-hand side adjustment assembly 42 also carries the joint 47, pivotally joining the assembly with the lever arm as previously explained. The inner end of each lever arm 70 is keyed or otherwise fixed to a shaft 72. The shaft 72 carries a pinion gear 74 which rotates when the lever arm 70 is moved by the tire rod. A second shaft-mounted pinion gear 76 engages the pinion gear 74 and is rotated thereby. Each of the aforementioned pairs of tapered wedges 50, 52 and 54, 56 have respective end portions which carry a rack gear segment 80. The rack gear segments 80 each engage opposite sides of the second pinion gears 76. Thus, rotation of the second pinion gear 76 causes opposite sliding movement of the wedges within each of the pairs of wedges.

Figure 3:
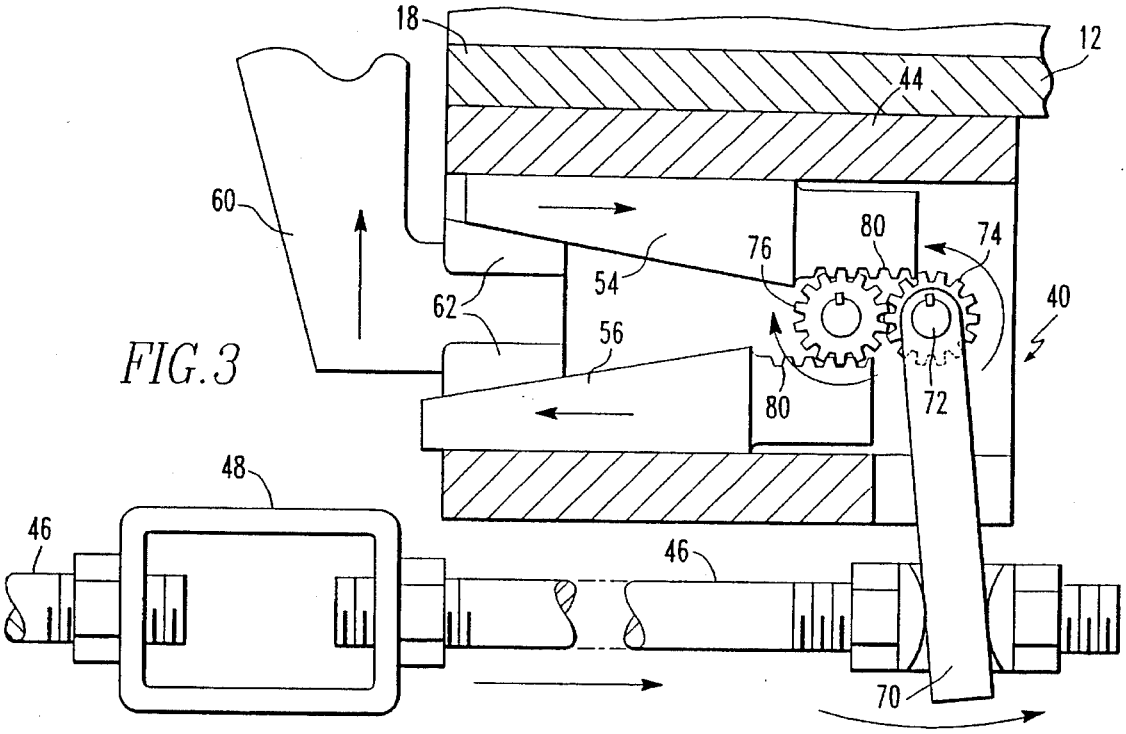
FIG. 3 is a slightly enlarged view of the right-hand side adjustment assembly shown in FIG. 2 showing outward or extended movement of the tie rod and consequent movement of the gear train and tapered wedges.

In operation, as best seen in FIG. 3, when the turnbuckle 48 is selectively rotated in a first direction, both of the tie rod segments move outwardly, causing identical outward movement of the attached lever arms 70. The outward movement of the right-hand side lever arm causes a counterclockwise movement of the first pinion gear 74 which results in the clockwise movement of the second pinion gear 76 within the right-hand side adjustment assembly 44. As a result, the rack gears 80, meshed with the second pinion gear 76, cause the upper wedge 54 of the right-hand side pair of wedges to retract inwardly, while the lower wedge 56 slideably extends outwardly. This movement of the right-hand wedge pair 54, 56 as shown in FIG. 3, is identical to the movement of the left-hand side pair of wedges 50, 52 of the adjustment assembly 42 (FIG. 2) and causes the transverse wing portion 62 of the laterally extending pair of roll chock members 60, roll chock 10 and the lower roll 6 to all move in an axially inward direction.

Figure 4:
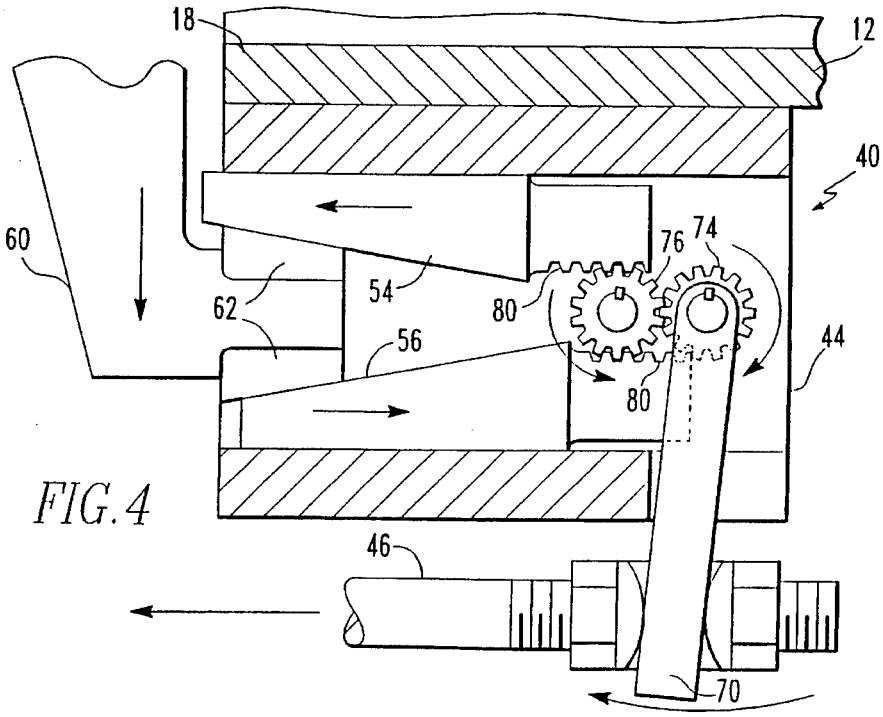
FIG. 4 is a view similar to FIG. 3 showing inward or retracted movement of the tie rod and consequent movement of the gear train and tapered wedges.

Rotation of the turnbuckle 48 in a second direction causes the tie bar segments 46 to retract inwardly as shown in FIG. 4. This movement causes an inward movement of the lever arm 70 causing opposite rotative movement of the gears 74, 76 and opposite movement of the wedges 54, 56 than described above with reference to FIG. 3. As seen in FIG. 4, the upper wedge 54 slidably extends while the lower wedge 56 retracts, causing the transverse wing portions 62 of the lateral members 60, roll chock 10 and bottom roll 6 to all move in an axially outward direction.

Thus, it can be readily seen that the lower roll chock 10 and its journaled lower roll 6 can be axially adjusted in an expeditious manner employing the adjustment device 40 of the invention. In this manner, it is possible to align the grooves in the top and bottom work rolls in a plug mill with a minimum of time, labor and capital expense. In addition, the roll adjustment is accomplished with a high degree of safety since there is no need to enter the mill window to effect the adjustment. The adjustment device 40 of the invention may be installed on new mills or easily retrofitted on existing mills.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. Adjustment device for axially aligning a work roll in a mill comprising:

(a) a roll chock supporting said work roll in the mill, the roll chock including laterally extending means carrying transverse, tapered wing portions;

(b) a pair of spaced-apart adjustment assemblies mounted on the mill, each of said adjustment assemblies including a pair of tapered wedges, engaging the respective transverse, tapered wing portions of the laterally extending means of the roll chock member, each of said adjustment assemblies also including gear means for slideably moving said pairs of wedges and said engaged wing portions; and (c) gear moving means for selectively moving said gear means, whereby, when said gear means are moved, the resultant movement of the wing portions of the laterally extending means of the roll chock causes axial movement of the work roll.

2. The adjustment device of claim 1 wherein the means for moving the gear means comprises a pair of lever arms, operably engaging said gear means on each of said adjustment assemblies, and a tie rod means interconnecting said lever arms, said tie rod means including a turnbuckle, whereby, selective rotative movement of said turnbuckle causes identical movement of the tie rod means and lever arms.

3. The adjustment device of claim i wherein said gear means in each of the adjustment assemblies comprises a first pinion gear operably engaging said gear moving means, a second pinion gear operably engaging said first pinion gear, and rack gears carried by each of said pair of tapered wedges operably engaging said second pinion gear.

4. The adjustment device of claim 1 wherein the mill is a plug mill.

5. The adjustment device of claim 1 wherein the work roll to be aligned is a bottom roll.

6. Adjustment device for axially aligning a bottom work roll in a plug mill comprising:

(a) a roll chock supporting said bottom work roll in the plug mill, the roll chock including a pair of laterally extending members each carrying a transverse, tapered wing portion;

(b) a pair of spaced-apart adjustment assemblies mounted on the mill adjacent a side of the roll chock carrying said laterally extending members, each of said adjustment assemblies including a pair of tapered wedges, engaging a respective transverse, tapered wing portion, each of said adjustment assemblies also including gear means for slideably moving said pairs of wedges and said wing shaped portions; each of the adjustment assemblies further including lever arms for moving said gear means; and (c) a tie rod interconnecting the lever arms of each of the adjustment assemblies, said tie rod comprising two segments having threaded ends interconnected by a turnbuckle whereby selective rotative movement of the turnbuckle causes identical movement of the lever arms and said gear means whereby said gear means moves said pairs of tapered wedges causing movement of the transverse, tapered wing shaped portions of the laterally extending roll chock members and axial movement of the bottom work roll.

7. The adjustment device of claim 6 wherein said gear means in each of the adjustment assemblies comprises a first pinion gear operably engaging said lever arms, a second pinion gear operably engaging said first pinion gear, and rack gears carried by each of said pair of tapered wedges operably engaging said second pinion gear.

8. Adjustment device for axially aligning a bottom work roll in a plug mill comprising:

(a) a roll chock supporting said bottom work roll in the plug mill, the roll chock including a pair of laterally extending members, each carrying a transverse, tapered wing portion;

(b) a pair of spaced-apart adjustment assemblies mounted on the mill adjacent a side of the roll chock carrying said laterally extending members, each of said adjustment assemblies including a pair of tapered wedges, engaging respective transverse, tapered wing portions of the laterally extending roll chock members, each of said adjustment assemblies also including a lever arm, a first pinion gear turnable by said lever arm, a second pinion gear positioned between end portions of the pair of tapered wedges and operably engaging said first pinion gear, rack gears carried by the end portions of each of said pair of tapered wedges operably engaging said second pinion gear; and (c) a tie rod interconnecting the lever arms of each of the adjustment assemblies, said tie rod comprising two segments having threaded ends interconnected by a turnbuckle, whereby, rotative movement of the turnbuckle causes identical movement of the tie rod segments and lever arms, whereby, the lever arms move the respective first and second pinion gears and the rack gears of said pairs of tapered wedges causing movement of the transverse wing portions of the laterally extending members of the roll chock and selective axial movement of the bottom work roll.

9. An improved plug mill of the type including a mill housing, a pair of grooved upper and lower work rolls rotatably mounted in respective upper and lower roll chocks, the roll chocks being mounted in said mill housing, the improvement comprising an adjustment device for axially aligning the groove of the bottom work roll with the groove of the top work roll, the adjustment device including:

(a) a pair of laterally extending members integral with the lower roll chock, the laterally extending members each having a transverse, tapered wing portion;

(b) a pair of spaced-apart adjustment assemblies mounted on the mill, each of said adjustment assemblies including a pair of tapered wedges, engaging respective transverse, tapered wing portions of the laterally extending members, each of said adjustment assemblies also including gear means for slideably moving said pairs of wedges and said transverse, tapered wing portions, each of the adjustment assemblies further including lever arms for moving said gear means; and (c) a tie rod interconnecting the lever arms of each of the adjustment assemblies, said tie rod comprising two segments having threaded ends interconnected by a turnbuckle whereby rotative movement of the turnbuckle causes identical movement of the lever arms and said gear means whereby said gear means moves said pairs of tapered wedges causing movement of the transverse, tapered wing portions of the laterally extending members of roll chock and selective axial movement of the bottom work roll.

10. The plug mill of claim 9 including a pair of vertical locking plate means slideably mounted on the mill housing and selectively moveable between first and second positions to lockably engage the upper and lower roll chocks in the mill housing in the first position and to releasably disengage the roll chocks when moved to the second position.

* * * * *

UNITED STATES PATENT AND TRADEMARK OFFICE

CERTIFICATE OF CORRECTION

PATENT NO. : 5,524,470

DATED : June 11, 1996

INVENTOR(S) : William Rozmus

It is certified that error appears in the above-indentified patent and that said Letters Patent is hereby corrected as shown below:

Title page, item '[73] Assignee:', "Italimplanti" should read --Italimpianti--.

Column 1 Line 20 after "hollow" delete --,--.

Column 3 Line 25 "20" should read --21--.

Column 4 Line 12 "tire" should read --tie--.

Claim 3 Line 28 Column 5 "claim i" should read --claim 1--.

Signed and Sealed this

Twelfth Day of November, 1996

*Attest:*

Bruce Lehman

BRUCE LEHMAN

*Attesting Officer*

*Commissioner of Patents and Trademarks*